United States Patent [19]

Asano

[11] 4,057,013

[45] Nov. 8, 1977

[54] ROLLING PRINTING MACHINE

[75] Inventor: Shinzo Asano, Tokyo, Japan

[73] Assignees: Fuji Shiko Kabushiki Kaisha; Kabushiki Kaisha Asano Tekkosho, both of Tokyo, Japan

[21] Appl. No.: 759,234

[22] Filed: Jan. 13, 1977

Related U.S. Application Data

[63] Continuation-in-part of Ser. No. 612,022, Sept. 10, 1975, abandoned.

[30] Foreign Application Priority Data

May 21, 1975 Japan ..... 50-60441

[51] Int. Cl.[2] ..... B41F 17/00

[52] U.S. Cl. ..... 101/212; 101/269; 101/353; 101/DIG. 6

[58] Field of Search ..... 101/212, 250, 353, 256, 101/260, 261, 264, 269, 270, 277, 282, 353, 356, 358, DIG. 6

[56] References Cited

U.S. PATENT DOCUMENTS

| | | | |
|---|---|---|---|
| 1,362,100 | 12/1920 | Henderson | 101/415.1 |
| 1,684,592 | 9/1928 | Luck | 101/212 X |
| 2,853,943 | 9/1958 | Royer | 101/352 X |

FOREIGN PATENT DOCUMENTS

| | | | |
|---|---|---|---|
| 700,222 | 2/1931 | France | 101/212 |

*Primary Examiner*—J. Reed Fisher

*Attorney, Agent, or Firm*—Cushman, Darby & Cushman

[57] ABSTRACT

There is disclosed a printing press comprising an ink reservoir above the plurality of ink feed rollers in communication with said reservoir, at least one inking roller disposed below and in communication with said feed rollers, a plurality of ink application rollers displaceable into communication with said at least one inking roller by swing arms connected at one end to said ink application rollers and having tension springs attached to their other ends, a printing roller beneath said ink application rollers having a horizontal center support laid in a center notch or a carrier frame, a plurality of rollers supporting said frame for reciprocating movement towards and backwards on a horizontal rail, a paper feeding device arranged to feed paper periodically and in sequence with said movement of the frame beneath a printing block on the printing roller, entrainment means for said printing roller to rotate it at the same peripheral speed as the speed of the frame movement, and driving means for driving the frame and printing roller through a crank and a gear sector said driving means being coupled directly or indirectly with a mechanism for displacement of said swing arms of the ink application rollers.

1 Claim, 19 Drawing Figures

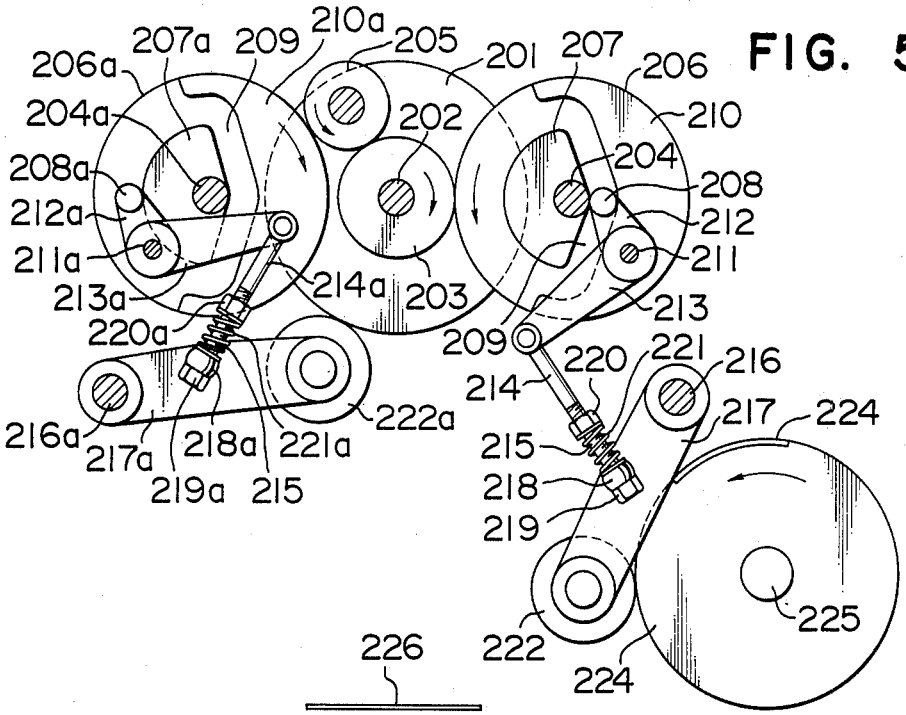
FIG. 5
FIG. 6
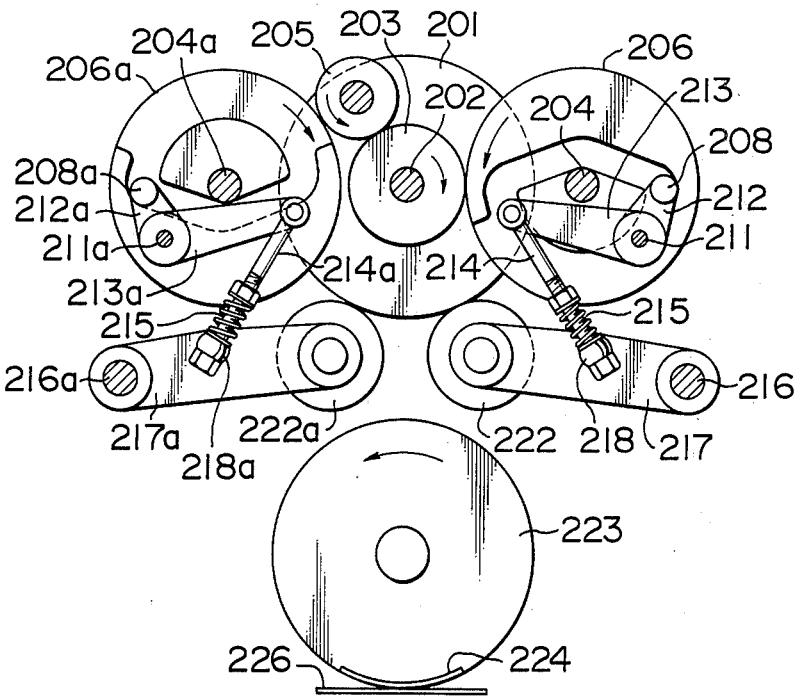

ROLLING PRINTING MACHINE

REFERENCE TO RELATED APPLICATION

This is a continuation-in-part of U.S. patent application Ser. No. 612,022, filed Sept. 10, 1975, now abandoned.

FIELD OF THE INVENTION

This invention relates to a printing machine, its printing roller, stamp and its ink-application roller, mainly for strap printing for seals.

DESCRIPTION OF THE PRIOR ART

It is conventional that a printing roller be provided with a printing stamp in the form of a block sheet or relief which wraps about the whole of the peripheral surface of the printing roller, and from one end to the other. For such rollers, block sheets are difficult to make, are heavy, so cumbersome to attach about the roller, and may undesirably print irregularly.

SUMMARY OF THE INVENTION

According to the invention, there is provided a printing press comprising a plurality of feed rollers for feeding ink to at least one inking roller, a plurality of ink application rollers displaceable into and out of the engagement with said inking roller or rollers for the transfer of the ink therefrom to a printing roller, carrier means rotatably supporting said printing roller and means for reciprocating displacement of the carrier means along a guide over a bed or support for the paper or other material to be printed while rotating the printing roller to cause it to roll over said bed or support, means for feeding said paper in step-wise manner for printing by said printing roller, and drive means arranged to actuate said displacements of the carrier means and the printing roller and of the ink application rollers in sequence with each other.

More particularly, there may be provided a printing press comprising an ink reservoir above a plurality of ink feed rollers in communication with said reservoir, at least one inking roller disposed below and in communication with said feed rollers; a plurality of ink application rollers displaceable into communication with said at least one inking roller by swing arms connected at one end to said ink application rollers and having tension springs attached to their other ends, a printing roller beneath said ink application rollers having a horizontal centre support laid in a centre notch of a carrier frame, a plurality of rollers supporting said frame for reciprocating movement forwards and backwards on a horizontal rail, a paper feeding device arranged to feed paper periodically and in sequence with said movement of the frame beneath a printing block on the printing roller, entrainment means for said printing roller to rotate it at the same peripheral speed as the speed of frame movement, and driving means for driving the frame and printing roller through a crank and a gear sector said driving means being coupled directly or indirectly with a mechanism for displacement of said swing arms of the ink application rollers.

BRIEF DESCRIPTION OF THE DRAWINGS

The invention will be more particularly described with reference to the accompanying drawings, wherein:

FIGS. 5 to 7 are views of a mechanism for the inking roller and ink application rollers of a further press according to the invention, showing the mechanism at different stages of its operation.

DESCRIPTION OF THE PREFERRED EMBODIMENTS

Figure 1:
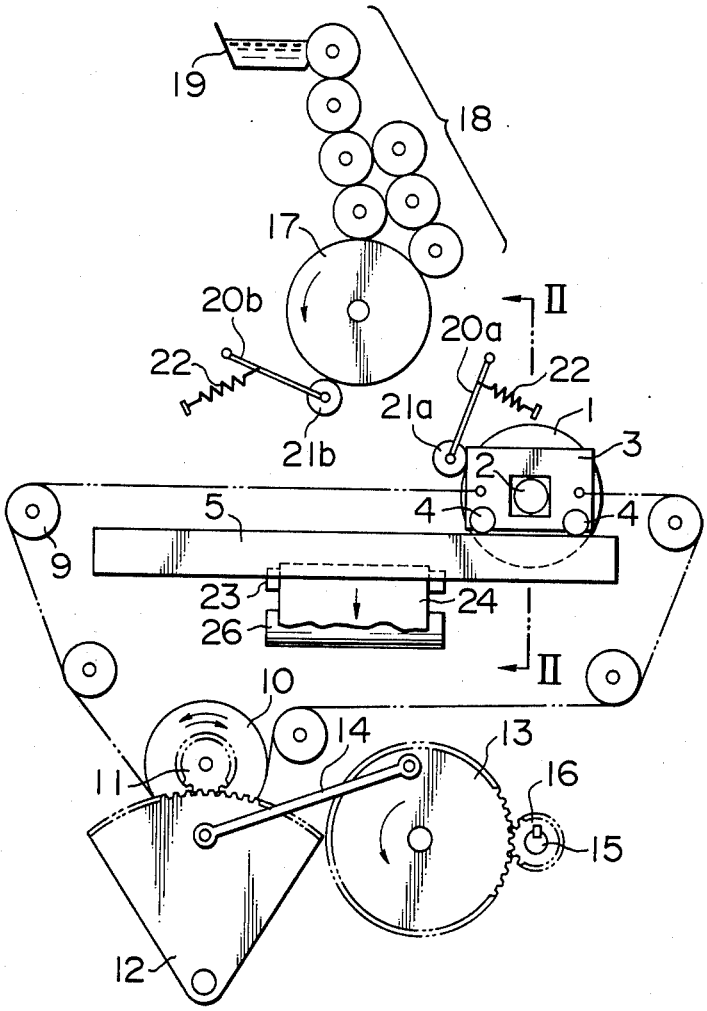
FIG. 1 is a side elevation of a printing press according to the invention.
Figure 2:
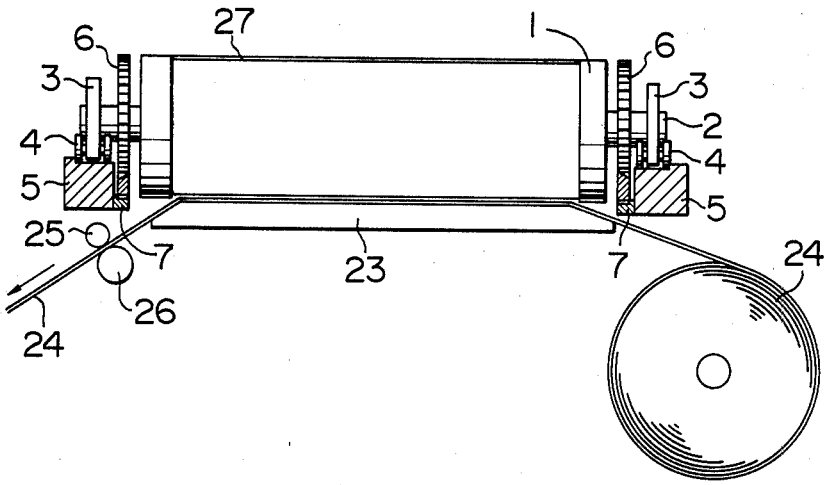
FIG. 2 is a cross sectional view on line II—II in FIG. 1.

FIGS. 1 and 2 show a printing roller 1 supported at the ends of its shaft 2 on a pair of trunnions 3 forming a carrier that is mounted on horizontal rails 5 on the press base by rollers 4 so as to be reciprocable on the rails. The printing roller is rotatable in its trunnions and fixed at the ends of the roller are pinions 6 having a pitch circle the same as the roller diameter and meshing with respective toothed racks 7 fixed to the rails 5. A chain 8 is attached to the trunnions at both ends and extends over a plurality of guide wheels 9 and a driving sprocket wheel 10, the sprocket wheel being fixed to a gear 11 driven by a gear segment 12 connected by a crank 14 to a gear 13 that meshes with drive gear 13 driven by a prime mover such as an electric motor.

Located centrally above the horizontal rails 5 and rotatable on an axis parallel with said roller 1 is an inking roller 17, above which are provided a plurality of ink feeding rolls 18 and an ink reservoir 19. Pivoted on the support frames (not shown) at both ends of the inking roller 17 are pairs of arms **20*a*, 20*b*, at the free ends of which are mounted respective ink application rollers 21*a*, 21*b* in a freely rotatable manner. The rollers 21*a*, 21*b* are each biased downwardly by means of tension springs 22, but means, to be described in more detail hereinafter, are provided to swing the rollers upwards alternately in synchronisation with the reciprocating movement of the printing roller 1, thereby causing each ink application roller to contact the surface of the inking roller 17** periodically at a predetermined stage in its movement.

Provided at the same level as the bottom of the printing roller 1 and centrally of the length of the horizontal rails 5 is at least one of guide plate 23, over which a paper web 24 is to be printed is fed, extending axially of the printing roller 1. The paper web is held between a pressure roller 25 and a drive roller 26 that is operated so as to cause the web to be advanced periodically in said axial direction in synchronism with the reciprocatory movement of printing roller 1. Fixed over a part of the peripheral surface of the printing roller 1 is an arcuate printing block 27 that rolls upon that portion of the paper web on the guide plate 23 while the web is held stationary.

In operation, as the motor shaft 15 rotates the drive gear 12 rotates the gear 13 meshing with it and a certain reduction ratio is obtained by virtue of the relative sizes of the two gears. The gear 13 has its rotary motion transformed by the crank 14 into an oscillatory swinging motion of the gear segment 12 which in turn produces an oscillatory rotary motion of the gear 11. The sprocket wheel 10 fixed to and coaxial with said gear 11 correspondingly produces alternating forward and return movements of the chain 8 and thereby a reciprocatory movement of the trunnions 3 in unison along the rails 5. The trunnions 3 move with a minimum of friction due to the rolling of the supporting rollers 4, and the shaft 2 being carried by the trunnions, its printing roller 1 is entrained in said reciprocatory movement. Since the pinion 6 fixed to the roller 3 is in mesh with the rack 7 during this reciprocating movement, the printing roller 1 also performs one complete revolution, rolling at the same peripheral speed as the speed of movement of the trunnions 3. While moving from the position illustrated in FIG. 1, the roller 1 rotates counterclockwise and during the return stroke of the trunnions it rotates clockwise.

Figure 3A:
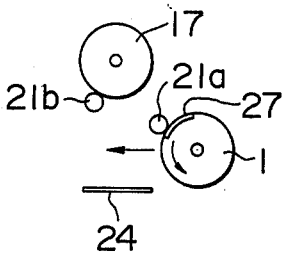
FIGS. 3(A) to (D) provides a series of schematic views showing an operational sequence of the printing roller and the ink application rollers in the machine of FIGS. 1 and 2.
Figure 3C:
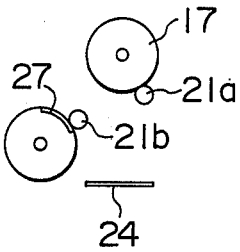
Figure 3B:
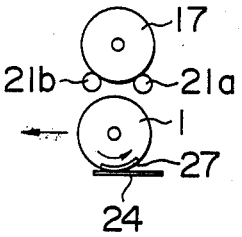
Figure 3D:
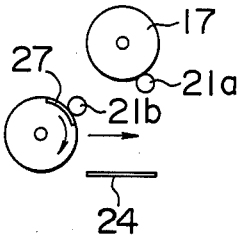

The rotation of the printing roller 1 controls the swinging movements of the ink application rollers 21*a,* 21*b* relative to the printing roller 1 and also the stepwise advance of the paper web. The manner of synchronisation is illustrated in FIGS. 3(A) to (D). When the printing roller 1 is in the end position illustrated in FIG. 1, as shown in FIG. 3(A), the ink application roller 21*a* has descended by the swinging movement of the pivot arm 20*a* to be in rolling contact with the peripheral surface of the printing roller 1. The inking roller 17 rotates continuously and is provided with a uniform ink layer on its peripheral surface by the ink feeding rollers 18. Consequently, the application roller 21*a* having already been in contact with the inking roller 17, applies ink onto a part of the surface of the printing roller 1 when in the position shown in FIG. 3(A).

Following this, as the printing roller 1 begins to move to the left and rotates at the same peripheral speed as the speed of reciprocation, the ink application roller 21*a* remains pressed into contact with the surface of the printing block 27 to complete the inking of the required area. The printing roller 1 continuing its rolling motion, runs over the paper web 24 in the central region at its stroke and prints thereon with a certain contact pressure. As the printing is completed and the printing roller 1 is in the region of its leftmost position, the paper web is advanced for a distance corresponding to the length printed and is then stopped again, whereupon the printing roller begins to move rightwards, rotating in the clockwise direction. When the printing roller 1 is moved from left to right, the ink application roller 21*b* applies the ink onto the printing block 27 in the same manner above-described.

Thus, the printing roller 1 rotates at a peripheral speed that is the same as its speed of reciprocating movement and prints on the paper web that is periodically advanced at right angles to the direction of the movement of the printing roller.

The pitching or swinging movements of the ink application rollers 21*a,* 21*b* and the periodical advance of the printing paper 24 act in synchronisation as above with respect to the reciprocation of the printing roller 1, such pitching movements being produced by a crank mechanism or a cam mechanism as described below in detail, while the periodical paper advance can be accomplished by providing a combination of a unidirectional rotary beak wheel or the like in the rotary movement mechanism.

The printing block 27 is mounted on an arcuate part of the peripheral surface of the printing roller 1 in curved form, so that it may be manufactured more easily than a printing block wholly encircling the roller surface. Since the roller (printing block 27) prints on the paper 24 with a rolling contact, it is possible to obtain a good quality of printing. The periodically advanced web has the printed lengths cut from it and as it is periodically stopped the cutting process can be performed precisely and efficiently with a pitching movement of the cutter.

In a modified construction now to be described, a pair of inking rollers are provided that rotate in opposite directions to each other. The ink application rollers each contact with the printing roller, one during the forward movement of the roller and the other during the return movement, and said ink application rollers contact respective ones of the inking rollers, the associated inking roller in each case rotating in the opposite direction to that of its ink application roller, said inking roller rotations being the same as the directions of rotation of the printing roller when that is contacted by the corresponding ink application roller.

This may be contrasted with the embodiment already described, where the ink application roller 21*b* rotating in counterclockwise direction after moving out of contact with the printing roller suddenly comes into contact with the inking roller rotating also in counterclockwise direction. There may, therefore, be a possibility of breaking some portion on the surface of the ink application roller, which may be made of, for example, rubber, as the ink application roller is then rotated in clockwise direction and subsequently in counterclockwise direction again when it returns into contact with the printing roller, an eventuality which would cause printing defects.

Figure 4:
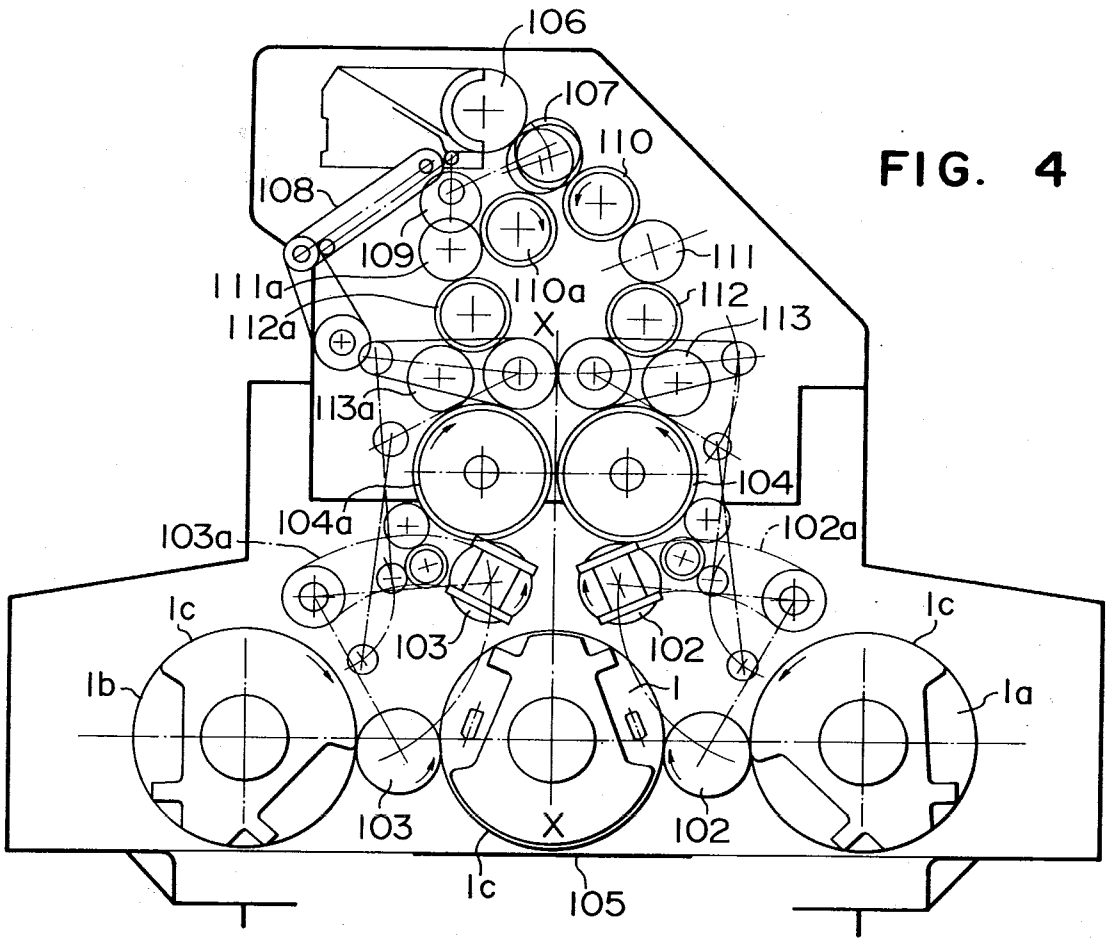
FIG. 4 is a partial side view of another embodiment of printing press according to the invention.

The modified construction is shown in FIG. 4, where the printing roller is shown at three different stages of its movement, advancing with a counterclockwise rolling motion from its right-hand end position 1*a* and returning with a clockwise rolling motion from its left-hand end position 1*b.* In each pass over paper web 105, the arcuate printing block 1*c* carried by the printing roller prints upon the paper while the web is held stationary, the web being advanced at right-angles to the direction of roller movement while the roller is in or near each of its end positions.

While the printing roller is advancing from the right-hand end position 1*a* to the printing region in the central part of its stroke, ink application roller 102 contacts with printing block surface and applies the ink thereon. To this end, the printing roller rotating in the counterclockwise direction rotates the ink application roller 102 in the clockwise direction as the ink is applied onto the printing roller and the roller 102 is then swung upwardly by its supporting arm 102*a* during the advance of the printing roller 1 into the central part of its stroke for printing, until the roller 102 contacts the inking roller 104 rotating in counterclockwise direction. This means the ink application roller continues to rotate in the same clockwise direction during the whole process, so ensuring that the ink application is smoothly made.

Similarly, as the printing roller completes the printing process, after which a stepwise advance of the paper web is made, and reaches its left-hand end position 1*b* a second ink application roller 103 swings down on its supporting arm 103*a* to contact the printing roller. When the printing roller begins its return stroke from the position 1*b*, it rotates in clockwise direction. Consequently, the ink application roller 103 contacting the printing roller to apply ink onto printing block portion 1*c*, is rotated in the counterclockwise direction. When the ink application roller 103 is raised on its supporting arm 103*a* as the printing roller 1 advances into the central parts of its stroke for printing, it reaches an inking roller 104*a* arranged symmetrically with the inking roller 104 with respect to a centre line X—X line the roller 104*a* being continuously rotated in the clockwise direction.

Therefore, as the ink application roller 103 rises while rotating in the counterclockwise direction and contacts the inking roller 104*a* rotating in clockwise direction, the ink application roller is able to maintain its original direction of rotation and ensure a smooth application of the ink.

As this occurs, the printing roller 1 will produce a further print on the paper web 105 and returns to its right-hand end position 1*a*, where the ink application roller 120 swings down on it supporting arm 102*a* to contact the printing roller again during that time that the paper web 105 is advanced and stopped again in preparation for the next print, whereupon the cycle can be repeated.

Thus, this embodiment provides a pair of inking rollers rotating in opposite directions supplying ink to a pair of ink application rollers which keep the same direction of rotation whether in contact with their inking roller or with the printing roller, thereby providing uniform ink application onto the printing block portion of the printing roller in both strokes of its reciprocating movement.

FIG. 4 also shows a reservoir 106 from which ink is transmitted through a roller 107 to the inking rollers 104 and 104*a*. For example, the ink roller 107 is displaceable between alternative positions for contact with ink feed rollers 110, 110*a*, respectively, that are arranged one to the left and one to the right of the centre line X—X while remaining in contact with the roller 107, said displacement being effected by an eccentric disc 109 rotated by a cradling arm 108. The ink feed rollers 110, 110*a* rotate in opposite directions to each other and supply the ink to the rollers 104, 104*a* through a further series of ink feed rollers 111, 112, 113 and 111*a*, 112*a*, 113*a*, respectively.

The swinging and pitching movements of the ink application rollers 102 and 103 are controlled by a cam mechanism for example, such as will now be described in more detail with reference to a further embodiment of the invention shown in FIGS. 5 to 8 of the drawings.

In these figures, there is shown the inking roller 201 mounted on a rotary shaft 202 to which is fixed a gear 203 which transmits the rotation to a first cam shaft 204 by direct engagement and to another cam shaft 204*a* through an intermediate gear 205 so that the cams on the two cam shafts are rotated in opposite directions to each other.

Fixed to the cam shafts 204, 204*a* are identical cams 206, 206*a* in identical relation to each other. The cams comprise respective sector-like projections 207, 207*a* the sides of which subtend angles a little less than 180° with respect to the cam shafts 204, 204*a*. Said sides of the sector-like projections form the inner edges of slots or tracks 209, 209*a* in which follower rollers 208, 208*a* are a free fit, the outer edges of said slots or tracks being formed by outer projections 210, 210*a* of the cams having a crescent-like shape.

The rollers 208, 208*a* contact the cams 206, 206*a* with a phase difference of 180°. Thus, in FIG. 5, the roller 208 is at the centre point of the cam track 206, namely at its closest to the cam shaft 204, while the roller 208*a* is at the centre of the arcuate portion of the sector-like projection, namely at a maximum distance from the cam shaft 204*a*. The rollers 208, 208*a* are rotatably mounted on levers 212, 212*a* pivoted on axes 211, 211*a* that are in fixed positions disposed symmetrically with respect to the rotary shaft 202 to opposite sides thereof.

On the same pivot axes 211, 211*a*, are levers 213, 213*a* in fixed relation with the levers 212, 212*a*, respectively, and on the outer ends of the levers 213, 213*a* are pivoted link arms 214, 214*a*. The other ends of the link arms are provided with helical threads 215 on which are screwed nuts 219, 219*a* to retain thereon connecting rings 218, 218*a* that are mounted on pivoting or swinging arms 217, 217*a* carrying respective ink application rollers on their free ends and pivoting on respective fixed axes 216, 216*a* at their other ends, said axes being disposed symmetrically with respect to the shaft 202. Adjusting nuts 220, 220*a* are also engaged with the threads 215 of the link arms 214, 214*a* and coil springs 221, 221*a* are disposed on the link arms 214, 214*a* between the adjusting nuts 220, 220*a* and the rings 218, 218*a*, thereby to urge the rings towards the securing nuts 219, 219*a* with a pressure that can be set by adjusting the positions of the adjusting nuts.

There is also shown a printing roller 223, on which circumference is provided a printing block 224, said printing roller 223 performing a rolling reciprocating movement in the horizontal plane and at right angles to the shafts 202 in the manner already described to print on a paper or like receiving surface 226.

Figure 8:
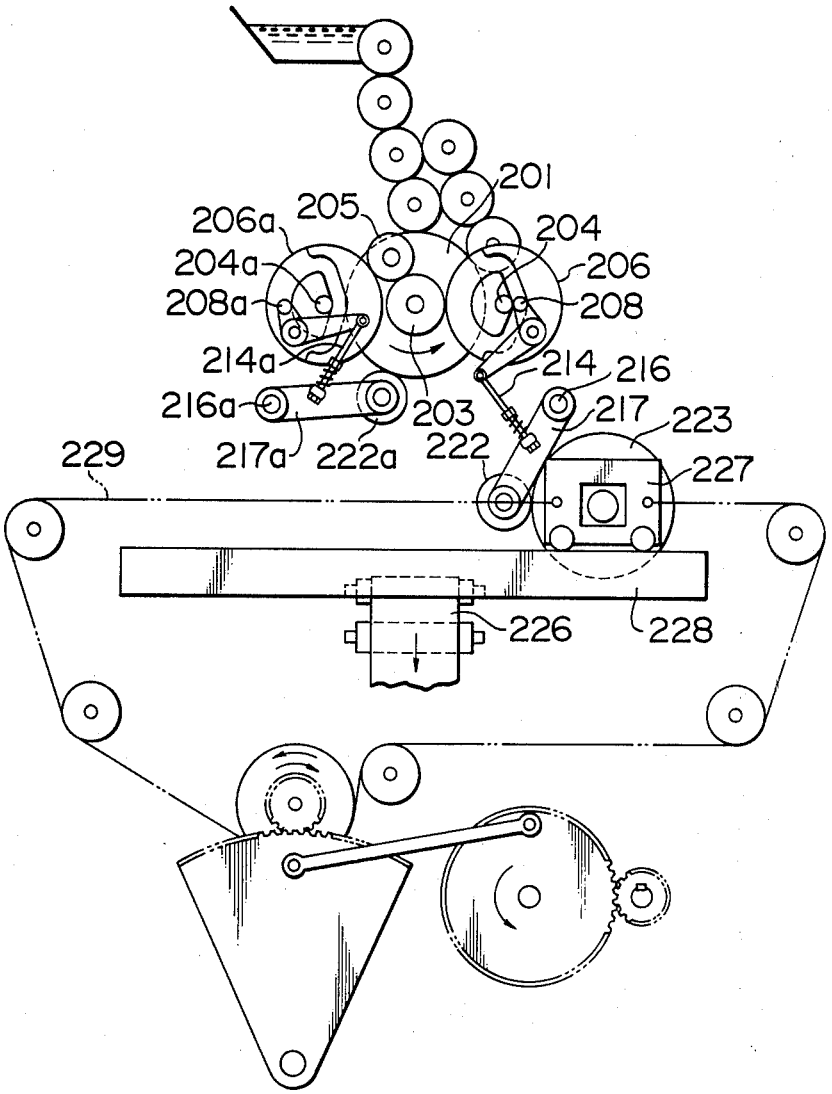
FIG. 8 is a side view of said further printing press incorporating the mechanism of FIGS. 5 to 7, FIGS. 9(A) to (D) provides a series of schematic views, similar to those in FIGS. 3(A) to (D) for the press of FIG. 3.

When the carrier frame 227 of the printing roller is at the right-hand end of a horizontal guide rail 228, as shown in FIGS. 5, 8 and 9 (A), the ink application roller 222 is brought into close contact with the printing roller 223, and the other ink application roller 222*a* is in close contact with the inking roller 201. The positional relation at this stage between the cams 206, 206*a* and rollers 208, 208*a* is shown in FIG. 5. When the frame 227 begins to move forwards (as arrowed in FIG. 9 (A)) and the printing roller 223 rotates in counterclockwise direction as it is entrained by it, swinging arm 217 carrying the ink application roller 222 pivots about the axis 216, so that the ink application roller 222 then applies the ink onto printing block 224 on the rotating printing roller. At the same time, due to rotating of the cam 206 anticlockwise, the roller 208 moves along the cam track 209 away from the axis 204 and, acting through the lever 213, raises the link arm 214 thereby drawing ink application roller 222 out of contact with the printing roller 223.

Figure 9A:
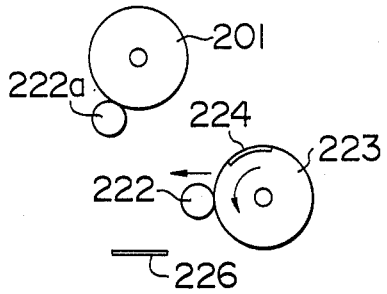
Figure 9C:
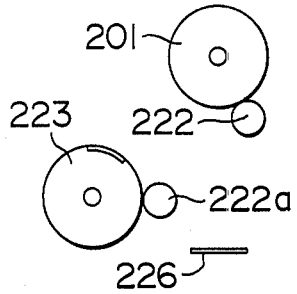
Figure 9B:
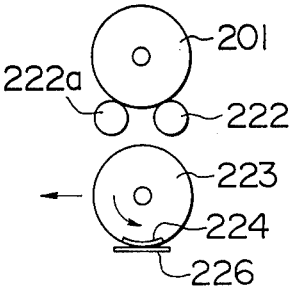
Figure 9D:
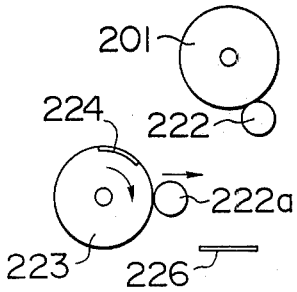

When the roller 208 reaches the outer end of the track 209, at the horn of the crescent-like projection 210, the link arm 214 is at its uppermost position thereby causing the ink application roller 206 to come in contact with the inking roller 217 as shown in FIGS. 6 and 9(B). At that time, the printing roller 223 has completed about half a revolution thereby bringing the printing blcok 224 to its lowermost position in contact with and printing upon the paper 226. In the case of the second cam 206*a,* which has moved from the position in FIG. 5 to the position in FIG. 6 by a 90° clockwise rotation, since its roller 208*a* has been moving along the arcuate face of the sector-like projection 207*a,* it has remained at a fixed position farthest from the cam axis 204*a* thereby permitting no rotation of the lever 213*a* and the link arm 214*a* is held at its upper position with the ink application roller 214*a* kept in contact with the inking roller 201.

Of course before the printing block reaches its lowermost position for printing, the printing paper will have been advanced to the printing position and held there, beneath the printing block and after the printing process, a further advance of the paper is begun and completed before the printing block again reaches the printing position in the return movement of the printing roller. The speed of feeding the printing paper 226 must thus be controlled in such a manner that each succeeding length of paper to be printed has been positioned before printing is begun on it and each advance is made after the preceding print has been effected.

Figure 7:
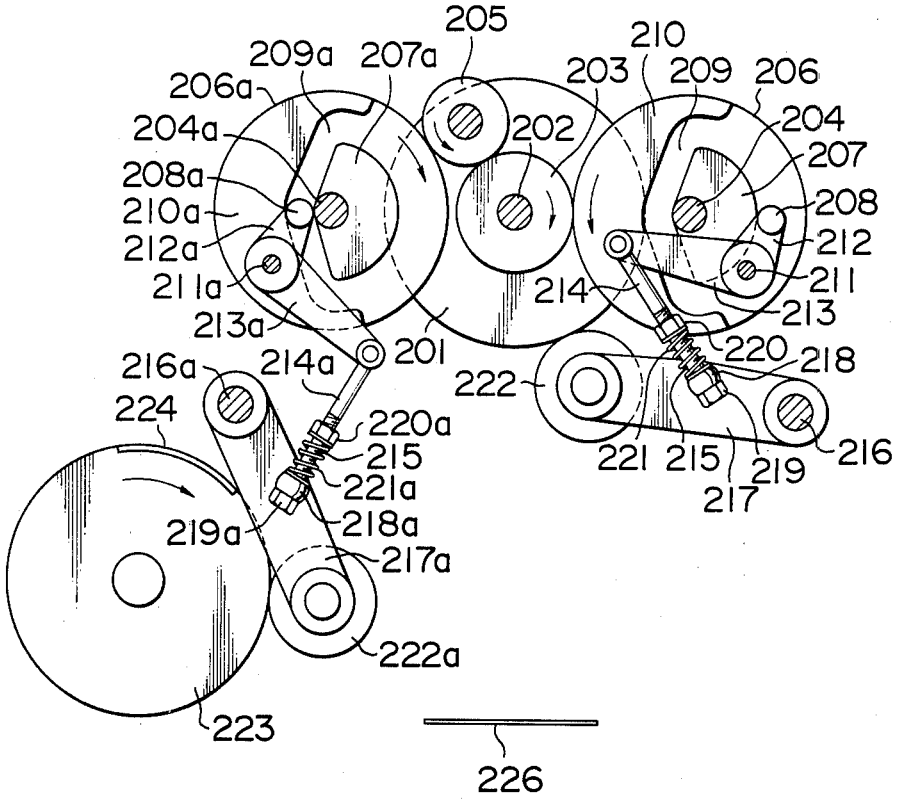

When the printing roller 223 reaches the end of its forward movement, the printing block 224 occupies the position shown in FIGS. 7 and 9(C), and in that time, the roller 208*a* following the cam 206*a* has gradually come closer to the cam axis 204*a* along the track 209*a,* thereby lowering the link arm 214*a* and causing the ink application roller 222*a* to come in contact with the printing roller. Thus, when the printing roller 223 begins its return movement, rolling in the clockwise direction, the ink application roller 222*a* keeps in contact with the printing roller taking up the link arm 214*a* thereby applying ink onto the printing block. As the printing roller completes about a half of a revolution in its return movement, the roller 208*a* is displaced steadily along the track 209*a* to a position remote from the cam axis 204*a* by a 90° rotation of the cam 206*a,* thereby lifting the link arm 214*a* to its uppermost position and so causing the ink application roller 222*a* to contact the inking roller 201. During that time, the ink application roller 222 supplying ink onto the printing block 224 during the forward movement of the printing roller, is kept in its uppermost position in contact with the inking roller by reason of the associated follower roller 208 being kept in contact with the arcuate face of the sector-like projection 207 of the cam 206. Thus, during the stage of the cycle shown in FIG. 6, both the ink application rollers 222, 222*a* are in contact with the inking roller 201 and cannot affect the motion of the printing roller 223 which at this same stage is thus able to move freely and smoothly in contact with the paper 226 to print on the paper.

At the end of the return movement of the printing roller, the inking roller 222 and the ink application rollers 222, 222*a* occupy the positions shown in FIG. 5 from which the cycle of movement can be repeated.

Conventionally, a heavy metallic printing plate or relief might be directly attached around the printing roller, but its mounting and removal is physically demanding and it is difficult to store it because of its weight and size. In a preferred feature of the present invention, an alternative construction is provided. As one example, this may comprise recessing an arcuate part of the printing roller, thereby forming a trapezoidal fixing portion, arrangement retaining hooks on adjustment screws on the sloping sides of said trapezoidal portion, engaging said retaining hooks with hooks fixed at the both ends of a thin metallic plate with a printing block affixed and covering a remaining arcuate portion of the printing roller, and then tightening said adjustment screws to draw said thin metallic plate attached into contact with said remaining arcuate portion.

Figure 10:
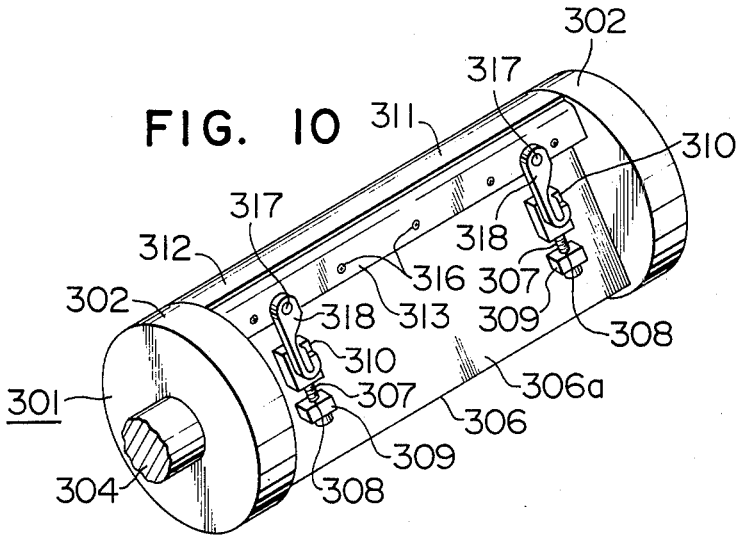
FIG. 10 is a perspective view of a preferred form of printing roller having recessed portion in which clamping hooks for a printing block are provided.
Figure 11:
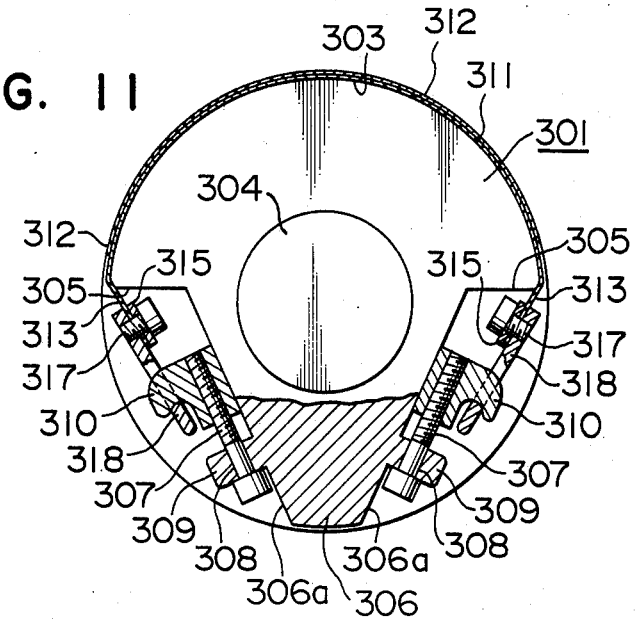
FIG. 11 is a transverse cross section of the roller in FIG. 10.
Figure 13:
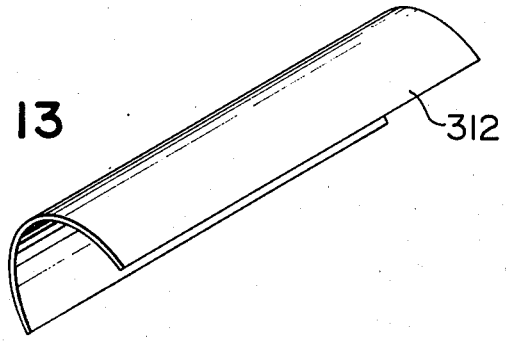
FIGS. 12 and 13 are perspective views of part of the roller in FIG. 11, showing the thin metal sheet and its attaching parts in exploded form and the printing block to be secured to the sheet, respectively.
Figure 12:
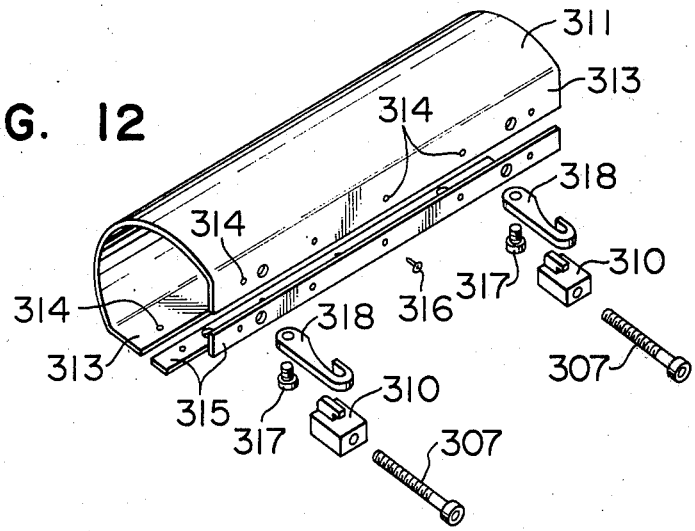

By way of further illustration, reference will be made to FIGS. 10 and 13 of the drawings which show a printing roller 301 with thick cylindrical ends 302, 302 between which is formed an arcuate portion 303 having a slightly smaller outer diameter. At the both ends of the arcuate portion 303 recess steps 305 are formed diametrically to the roller axis 304 and from the inner ends of said steps a trapezoidal-section fixing portion 306 is provided that is symmetrical with respect to the arcuate portion 303. On both sloping faces 306*a* of the portion 306 are protrusions 309 having holes 308 through which pass clamping screws 307 that engage respective retaining hooks 310.

A printing block or relief 312 is fixed attached, e.g., by adhesive, onto a thin metallic plate or sheet 311, which is provided with a series of small holes 314 on end margins 313 that are slightly inwardly curved of the arcuate or approximately semi-circular main part of the plate 311. On the inner faces of the end margins are seating plates 315 and screws 316 are secured through these and the holes 314 for strengthening the attachment of the plate 311. Utilising the screws 316 or other screws 317, hooks 318 are secured to both end margins 313 at positions laterally matching the positions of the retaining hooks 310.

Thus, after placing the thin metallic plate or sheet 311 around the portion 303 of the printing roller 301 each hook 318 is engaged with its respective retaining hook 310 then the clamping screws 307 are rotated, thereby causing the retaining hooks 310 to be drawn back evenly along the sloping faces 306*a* whereby the thin metallic plate 311 with its printing block 312 is firmly held against the arcuate portion 303.

It should now be apparent that the rolling printing machine, as described hereinabove, possesses each of the attributes set forth in the specification under the heading "Summary of the Invention" hereinbefore. Because the rolling printing machine can be modified to some extent without departing from the principles of the invention as they have been outlined and explained in this specification, the present invention should be understood as encompassing all such modifications as are within the spirit and scope of the following claim.

What is claimed is:

1. A printing press, comprising:

a plurality of ink feed rollers;

an ink reservoir disposed above said ink and in communication with feed rollers;

two inking rollers disposed below and in communication with said ink feed rollers, and arranged to rotate in opposite directions;

a plurality of ink application rollers, including at least one respective ink application roller for each of said two inking rollers, each arranged to rotate in a respective single direction then engaging the respective of said inking rollers;

a plurality of swing arms respective ones of said swing arms being connected at respective one ends thereof to said ink application rollers mounting the respective ink application rollers for displacement into communication with said ink feed rollers;

a plurality of tension springs attached to the respective opposite ends of said spring arm;

a printing roller disposed horizontally beneath said ink application rollers, and having a centre shaft;

a carrier frame;

means defining a centre notch in said carrier frame;

said printing roller centre shaft being supported by said carrier frame in said centre notch;

a horizontal rail;

a plurality of rollers supporting the carrier frame on the horizontal rail for reciprocating movement of the carrier frame backwards and forwards along said rail;

a printing block disposed on the printing roller;

a paper feeding device for feeding paper beneath said printing block periodically and in sequence with said movement of the frame;

means for rotating the printing roller at such an angular rate as will give the printing block the same peripheral speed as the speed of reciprocating movement of said frame and including drive means including a crank means coupled with a gear sector linked to said swing arms for providing said displacement of said ink application rollers.

* * * * *